US010837691B2

(12) United States Patent
Cordon Compañ

(10) Patent No.: US 10,837,691 B2
(45) Date of Patent: Nov. 17, 2020

(54) STOP SENSOR FOR AN ICE MACHINE

(71) Applicant: INDUSTRIA TECNICA VALENCIANA, S.A., Valencia (ES)

(72) Inventor: Cristina Cordon Compañ, Valencia (ES)

(73) Assignee: ITV ICE MAKERS, S.L., Valencia (ES)

( * ) Notice: Subject to any disclaimer, the term of this patent is extended or adjusted under 35 U.S.C. 154(b) by 127 days.

(21) Appl. No.: 16/211,021

(22) Filed: Dec. 5, 2018

(65) Prior Publication Data

US 2020/0173707 A1 Jun. 4, 2020

(30) Foreign Application Priority Data

Dec. 3, 2018 (EP) ..... 18382886

(51) Int. Cl.
*F25C 5/187* (2018.01)
*F25C 1/00* (2006.01)

(52) U.S. Cl.
CPC ..... *F25C 5/187* (2013.01); *F25C 1/00* (2013.01); *F25C 2700/02* (2013.01)

(58) Field of Classification Search
CPC ..... F25C 5/187; F25C 2700/02
See application file for complete search history.

(56) References Cited

U.S. PATENT DOCUMENTS 4,920,336 A * 4/1990 Meijer ..... A61M 5/1684 250/577
5,013,911 A * 5/1991 Koshida ..... G01V 8/10 250/239
6,286,324 B1 * 9/2001 Pastryk ..... F25C 5/187 62/137
6,314,745 B1 * 11/2001 Janke ..... F25C 5/005 62/137
6,351,958 B1 * 3/2002 Pastryk ..... F25D 21/04 250/227.25
8,196,419 B2 * 6/2012 Woo ..... F25C 5/22 62/137
8,424,323 B2 * 4/2013 Austin ..... F25C 5/187 62/137
8,616,013 B2 * 12/2013 Kim ..... F25C 5/187 62/135
8,635,877 B2 * 1/2014 Kim ..... F25C 5/187 62/137

(Continued)

FOREIGN PATENT DOCUMENTS

CN 2672780 Y * 1/2005
CN 1757997 A * 4/2006 ..... B67D 1/124

(Continued)

*Primary Examiner* — Nelson J Nieves
(74) *Attorney, Agent, or Firm* — Aslan Law, P.C.

(57) ABSTRACT

A stop sensor for an ice machine comprising a casing made up of a base and a cover, wherein the base acts as a housing for a sensor protected by glass, and which is arranged in an electronic board which in turn houses at least electronic means which send the stop signal; a probe, a light emitting diode and a switch; and in that the cover of the casing has a hole wherein a cap is housed which protects the sensor from possible inlets of water during the operation of the machine, and wherein in turn, said hole will coincide with the area where the button of the switch is located.

16 Claims, 4 Drawing Sheets

(56) References Cited

U.S. PATENT DOCUMENTS 8,959,939 B2 * 2/2015 Kim ..... F25C 5/187 62/137
9,097,450 B2 * 8/2015 Kim ..... G01F 23/2921
9,243,833 B2 * 1/2016 Yun ..... F25C 5/187
2002/0003083 A1 * 1/2002 Park ..... H01H 3/161 200/61.76
2007/0204644 A1 * 9/2007 Braun ..... F25D 25/025 62/344
2009/0211292 A1 * 8/2009 Smith ..... F25C 5/187 62/344
2009/0235681 A1 * 9/2009 Petrenko ..... F25C 1/12 62/351
2010/0139299 A1 * 6/2010 Lee ..... G01F 23/2921 62/137
2011/0100039 A1 * 5/2011 Kim ..... F25C 5/22 62/139
2013/0283893 A1 * 10/2013 Earl ..... G01N 33/2882 73/61.71
2015/0121942 A1 * 5/2015 Yun ..... F25C 5/187 62/344
2016/0370062 A1 * 12/2016 Yang ..... F25C 5/22
2016/0370080 A1 * 12/2016 Yang ..... F25C 5/187
2018/0313593 A1 * 11/2018 Olvera ..... F25D 17/065
2019/0175847 A1 * 6/2019 Pocreva, III ..... A61M 15/0065
2019/0254534 A1 * 8/2019 Koltowski ..... A61B 5/087

FOREIGN PATENT DOCUMENTS

CN 201164616 Y * 12/2008
CN 104543313 A * 4/2015 ..... A23G 9/283
CN 204423319 U * 6/2015
CN 106288947 A * 1/2017
CN 107817910 A * 3/2018
CN 207163496 U * 3/2018
EP 2399090 B1 * 8/2018 ..... F25C 5/187
KR 20100063241 A * 6/2010
WO WO-2005029819 A1 * 3/2005 ..... H04M 1/0291
WO WO-2011013951 A2 * 2/2011 ..... G06K 9/20
WO WO-2015040580 A1 * 3/2015 ..... F25C 5/187
WO WO-2016098424 A1 * 6/2016 ..... F24F 7/00

* cited by examiner

STOP SENSOR FOR AN ICE MACHINE

OBJECT OF THE INVENTION

The object of the present specification is a stop sensor for an ice machine, the function of which will be that of stopping the cited machine when the silo in which it is attached is full of ice, and once the ice has been released, the machine starts up again.

BACKGROUND OF THE INVENTION

Currently, in the field of manufacturing ice cubes, and more specifically in the machines designed to that purpose, there are diverse systems or means for detecting obstructions which emit a signal that stops the cited machine with the aim of preventing possible defects therein.

One of said means or devices are those commonly known as thermostats, wherein when the ice touches the bulb of the cited thermostat, the stopping will be activated. Thus, the described problem is solved; nevertheless, among the drawbacks of this solution is the fact that it is difficult to adjust to low ambient temperatures, which causes the installation thereof to not be viable at temperatures below 5° C.

Another type of solution is the one known as photoelectric sweeping, which is designed to respond to changes in the intensity of the light received, being activated in said cases. This type of solution has the main drawback of being very sensitive to ambient light; and furthermore, it is made up of an emitter and a receiver, therefore, it requires a more adjusted definition thereof, and requires greater maintenance than other similar solutions.

Finally, there are other machines which perform a complete mechanical stop thereof when they detect the problem. Nevertheless, this type of solution requires an operator to readjust the machine, and there is the risk that due to the stopping, certain components can become misaligned, which are necessary for the correct operations thereof. Therefore, the reliability of the solution is called into question.

DESCRIPTION OF THE INVENTION

The technical problem solved by the present invention is achieving a device that can determine the stopping of the machine when the silo where it is stored is full of ice and that in turn is able to reset the machine and determine the start-up thereof. To do so, the stop sensor for an ice machine, object of the present specification, is characterized in that it comprises a casing wherein the base thereof acts as a housing for a sensor protected by glass, and that is arranged in an electronic board which in turn houses at least electronic means that send the stop signal, a probe, a light emitting diode and a switch.

Due to the design thereof, the sensor contemplated herein will be able to measure the distance at which the object interrupting is, and therefore activate when it detects an anomaly, stopping the machine. Once the anomaly disappears, the machine will start up again.

The incorporation of the button will enable the distance at which the stop is activated to be regulated at will, with a maximum of two meters. This gives rise to the possibility of adjusting the filling for different types of installations (silo, chamber, etc.), thus, it will be able to be used in a greater number of ice-making machines.

Likewise, the regulation of the sensor will enable the operators thereof to be able to adapt the amount of ice stored to the needs required at any given time, such as for example, weekly, monthly, seasonally, etc.

Preferably, the sensor will be placed next to the outlet mouth for ice (shielded from drips and/or splashes), such that it is kept clean from lime or other deposits that could affect the measuring of the distance and therefore, of the correct operation thereof.

In turn, the sensor will be designed to work at low ambient temperatures, with a low sensitivity to ambient light.

BRIEF DESCRIPTION OF THE FIGURES

What follows is a very brief description of a series of drawings that aid in better understanding the invention and which are expressly related to an embodiment of said invention that is presented by way of a non-limiting example of the same.

DESCRIPTION OF A DETAILED EMBODIMENT OF THE INVENTION

Figure 1:
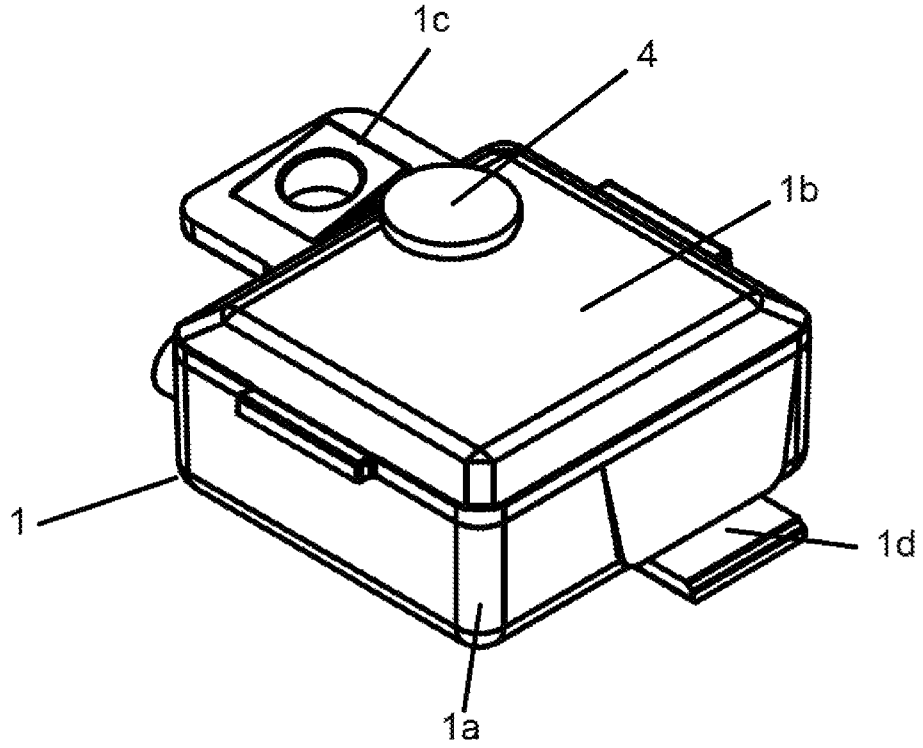
FIG. 1. Shows a view of the stop sensor for an ice machine, object of the present specification.
Figure 2:
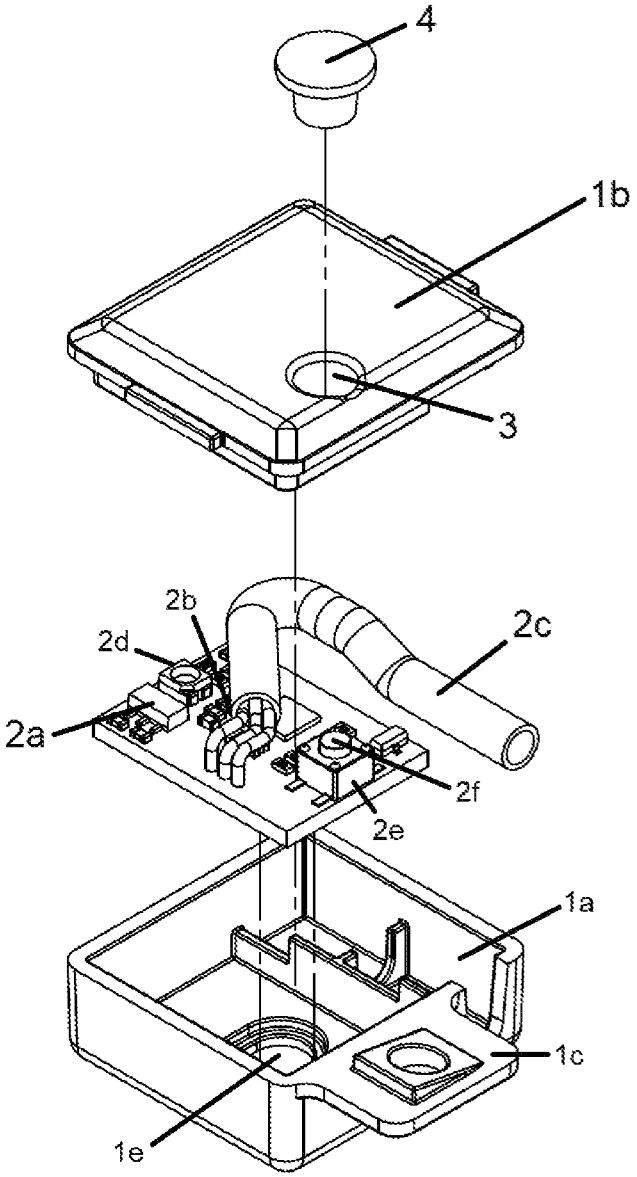
FIG. 2. Shows an exploded view of the stop sensor for an ice machine.
Figure 3:
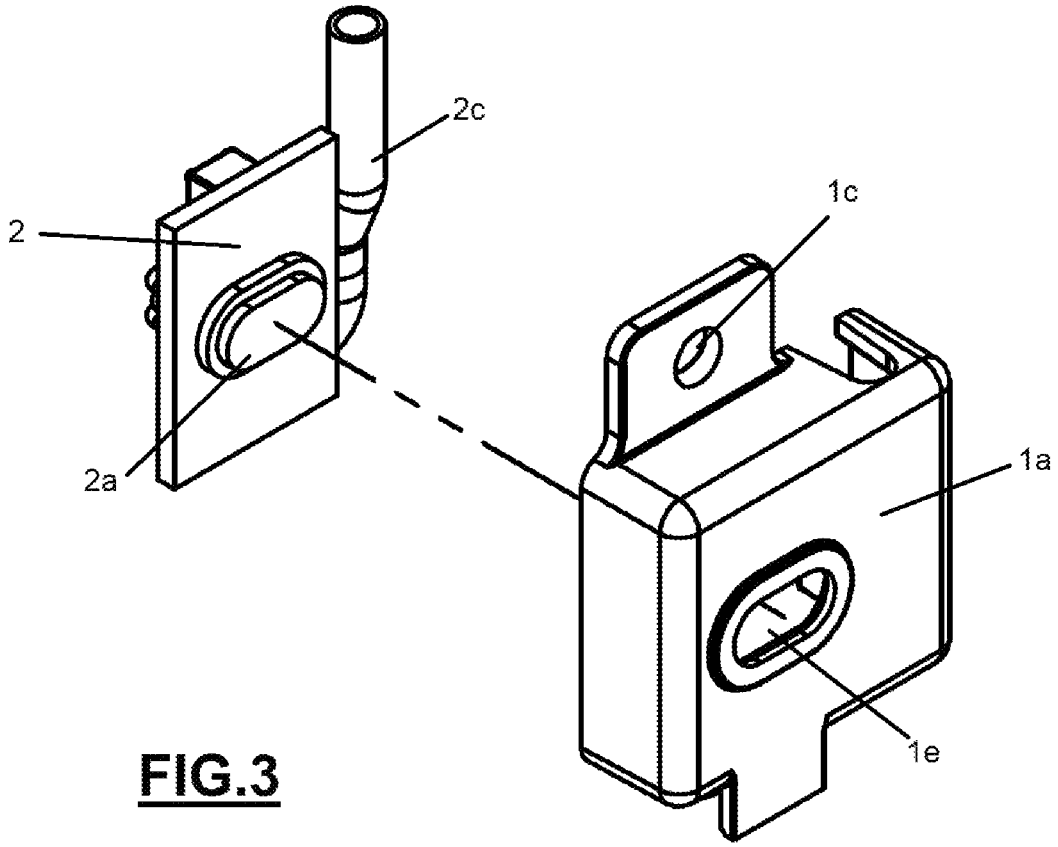
FIG. 3. Shows a bottom view of the electronic board (2) as part of the stop sensor for an ice machine.
Figure 4:
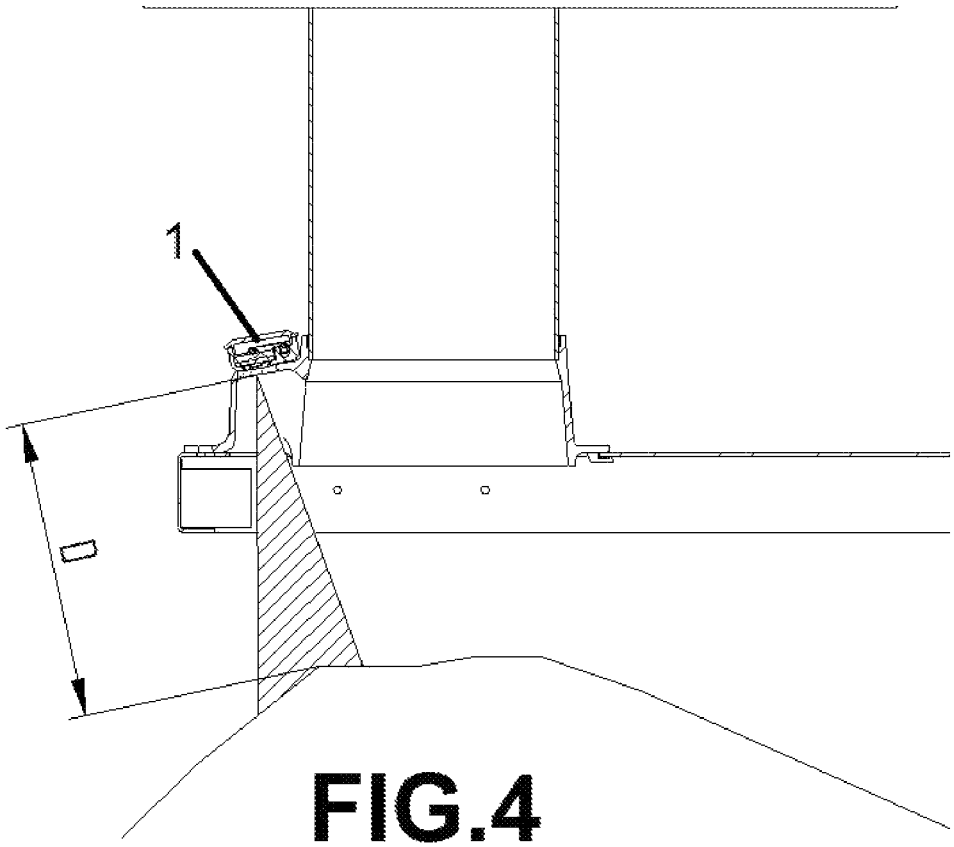
FIG. 4. Shows a view of the area of influence and detection of the sensor (2*a*) as part of the stop sensor for an ice machine.

The attached figures show a preferred embodiment of the invention. More specifically, the stop sensor for an ice machine, object of the present specification, is characterized in that it comprises a casing (1) made up of a base (1*a*) and a cover (1*b*), wherein the base (1*a*) which acts as a housing for a sensor (2*a*) protected by glass, and is arranged in an electronic board (2) which in turn houses at least electronic means (2*b*) which send the stop signal; a probe (2*c*), a light emitting diode (2*d*) and a switch (2*e*).

The electronic board (2) and a portion of the cable which makes up the probe (2*c*) have a layer of resin on the surface thereof, without surpassing the upper portion of the switch (2*e*), leaving the button (2*f*) free, preventing interferences with the lid (1*b*) of the casing (1).

The cover (1*b*) of the casing (1) has a hole (3) wherein a cap (4) is housed which protects the sensor from possible inlets of water during the operation of the machine, and wherein in turn, said hole (3) will coincide with the area where the button (2*f*) of the switch is located, such that it will not be necessary to take off the cover (1*b*) when the sensor (2*a*) is to be calibrated.

The base (1*a*) will have corresponding extensions (1*c*, 1*d*) which will facilitate the joining thereof to the ice-making machine. And a hollow (1*e*) where the sensor (2*a*) will be housed.

In a preferred embodiment, the sensor (2*a*) will detect a surface of up to two meters with a surface generated with an angle to the order of between 20° and 40°.

In a particular embodiment, the probe (2*c*) will have a length of up to two meters.

The invention claimed is:

1. A stop sensor for an ice machine, the stop sensor comprising:

a casing, the casing including:

a base, and a cover, wherein the base acts as a housing for a sensor protected by glass, and the sensor is arranged in or on an electronic board which in turn houses at least electronic circuit which send a stop signal;

a probe;

a light emitting diode; and a switch having a button, wherein the cover of the casing has a hole, in the cover of the casing, a cap is housed which protects the sensor from possible inlets of water, said hole coincides with the area where the button of the switch is located, wherein the sensor is configured and/or programmed to detect a surface of up to two meters with a surface generated with an angle to the order of between 20° and 40°.

2. The stop sensor for the ice machine according to claim 1, wherein the base has corresponding extensions which facilitate a joining of the stop sensor to the machine.

3. The stop sensor for the ice machine according to claim 2, wherein the probe has a length of up to two meters.

4. The stop sensor for the ice machine according to claim 1, wherein the probe has a length of up to two meters.

5. A stop sensor for an ice machine, the stop sensor comprising:

a casing, the casing including:

a base, and a cover, wherein the base acts as a housing for a sensor protected by lass and the sensor is arranged in or on an electronic board which in turn houses at least electronic circuit which send a stop signal;

a probe;

a light emitting diode; and a switch having a button, wherein the cover of the casing has a hole, in the cover of the casing, a cap is housed which protects the sensor from possible inlets of water, said hole coincides with the area where the button of the switch is located wherein the casing includes a lid, the probe includes a cable, the switch having an upper portion and a lower portion, and the electronic board and a portion of the cable have a layer of resin on the surface thereof, without surpassing the upper portion of the switch, leaving the button free, preventing interferences with the lid of the casing.

6. The stop sensor for the ice machine according to claim 5, wherein the sensor is configured and/or programmed to detect a surface of up to two meters with a surface generated with an angle to the order of between 20° and 40°.

7. The stop sensor for the ice machine according to claim 6, wherein the probe has a length of up to two meters.

8. The stop sensor for the ice machine according to claim 5, wherein the sensor is configured and/or programmed to detect a surface of up to two meters with a surface generated with an angle to the order of between 20° and 40°.

9. The stop sensor for the ice machine according to claim 8, wherein the probe has a length of up to two meters.

10. The stop sensor for the ice machine according to claim 5, wherein the probe has a length of up to two meters.

11. The stop sensor for the ice machine according to claim 5, wherein the base has corresponding extensions which facilitate a joining of the stop sensor to the machine.

12. The stop sensor for the ice machine according to claim 11, wherein the probe has a length of up to two meters.

13. The stop sensor for the ice machine according to claim 11, wherein the sensor is configured and/or programmed to detect a surface of up to two meters with a surface generated with an angle to the order of between 20° and 40°.

14. The stop sensor for the ice machine according to claim 13, wherein the probe has a length of up to two meters.

15. A stop sensor for an ice machine comprising:

a casing, the casing including:

a base, and a cover, wherein the base acts as a housing for a sensor protected by glass, and the sensor is arranged in or on an electronic board which in turn houses at least electronic circuit which send a stop signal;

a probe;

a light emitting diode; and a switch having a button, wherein the cover of the casing has a hole, in the cover of the casing, a cap is housed which protects the sensor from possible inlets of water, said hole coincides with the area where the button of the switch is located, the base has corresponding extensions which facilitate a joining of the stop sensor to the machine wherein the sensor is configured and/or programmed to detect a surface of up to two meters with a surface generated with an angle to the order of between 20° and 40°.

16. The stop sensor for the ice machine according to claim 15, wherein the probe has a length of up to two meters.

* * * * *